US008668329B2

(12) United States Patent
Ortmann et al.

(10) Patent No.: US 8,668,329 B2
(45) Date of Patent: Mar. 11, 2014

(54) PRINTING APPARATUS ARRANGED TO LOWER, POSITION AND RAISE PRESSURE ELEMENTS IN THE PRINTING APPARATUS

(75) Inventors: Axel Ortmann, Berlin (DE); Wolfgang Muhl, Hohen Neuendorf (DE); Dieter Woelm, Ludwigsfelde (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 141 days.

(21) Appl. No.: 13/286,389

(22) Filed: Nov. 1, 2011

(65) Prior Publication Data

US 2012/0120172 A1 May 17, 2012

(30) Foreign Application Priority Data

Nov. 11, 2010 (DE) ..... 20 2010 015 351 U

(51) Int. Cl.
*B41J 2/01* (2006.01)

(52) U.S. Cl.
USPC ..... 347/104; 347/101; 347/108

(58) Field of Classification Search
USPC ..... 347/29, 31, 32, 108, 109, 104, 101; 358/1.12; 403/322.2; 114/249
See application file for complete search history.

(56) References Cited

U.S. PATENT DOCUMENTS

| | | | | |
|---|---|---|---|---|
| 3,837,316 | A * | 9/1974 | Stratienko et al. | 114/249 |
| 4,813,810 | A * | 3/1989 | Suzuki | 403/322.2 |
| 6,343,786 | B1 | 2/2002 | Gregoire et al. | |
| 2003/0197881 | A1 * | 10/2003 | Inoue et al. | 358/1.12 |
| 2007/0147926 | A1 | 6/2007 | Rathbun et al. | |
| 2009/0152802 | A1 | 6/2009 | Hantel et al. | |
| 2009/0153609 | A1 | 6/2009 | Muhl | |
| 2009/0153636 | A1 * | 6/2009 | Hantel et al. | 347/104 |

FOREIGN PATENT DOCUMENTS

DE 100 60 454 A1 5/2002

* cited by examiner

*Primary Examiner* — Manish S Shah
*Assistant Examiner* — Yaovi Ameh
(74) *Attorney, Agent, or Firm* — Schiff Hardin LLP

(57) ABSTRACT

A printing apparatus has a path for transporting flat items in the x-direction, and allows insertion and removal of a box-shaped module along the y-direction. The box-shaped module has a pressure device that exerts pressure in the z-direction on the flat items to be transported. The x-direction, y-direction and z-direction are orthogonal to one another. The components of the box-shaped module in combination with guides of the printing apparatus cooperate to initially move the pressure device along the z-direction during insertion of the box-shaped module into the printing apparatus and to move said box pressure device opposite along the z-direction upon reaching a predetermined position.

7 Claims, 3 Drawing Sheets

PRINTING APPARATUS ARRANGED TO LOWER, POSITION AND RAISE PRESSURE ELEMENTS IN THE PRINTING APPARATUS

BACKGROUND OF THE INVENTION

1. Field of the Invention

The invention concerns an arrangement to lower, position and raise pressure elements of a printing apparatus.

As used herein, a printing apparatus is an apparatus that is designed to print on flat items to be printed during the passage of the flat items through the apparatus. Upon the occurrence of a jam of flat items to be printed in the transport path, or disruption of the passage of the flat items, removal of a box-shaped module from the printing apparatus is provided for the purpose of cleaning the sensors and the transport examination subject and to empty the ink capture reservoir. Upon insertion of the box-shaped module into the printing apparatus, the invention allows an automatic lowering, positioning and raising of pressure elements on the transport belt. Such as is suitable for use in franking machines, mail franking systems and other printing apparatuses or mail processing systems.

2. Description of the Prior Art

A transport device for flat goods to be printed is known from the European Patent Application EP 2072272 A2. This transport device has a driven transport belt supported on rollers, the transport belt being supported on a support plate. The flat items to be printed are pressed from below, counter to the force of gravity, onto the transport belt in the support region by means of support bars. During the printing the flat items are transported in the transport direction past at least one print head of a printing module and are pushed from above through a print window by means of the print head. The print window is arranged in a housing part of the printing apparatus at the edge of the transport belt.

A device to press flat items onto a transport module is known from European Patent Application EP 2072271 A2, wherein the pressure device is mounted in a lower housing shell and is equipped with pressure elements that can be lowered. The pressure elements act on the flat good to be printed with an elastic force through an opening in a feed table for flat items. An actuation element in order to activate a lowering device to which the pressure elements are attached is arranged on the lower housing shell. However, a lowering of the pressure elements does not allow any access to the sensors, transport elements and pressure elements.

A device to press flat items onto a transport module is known from European Patent Application EP 2072268 A2, wherein a support receptacle for pressure elements is arranged below a feed table and at least one of the pressure elements, with a number of individually elastically-supported components, is installed on the support receptacle. Alternatively, a number of pressure elements are arranged below the transport belt on the support receptacle, in the transport direction. However, an access to the sensors, transport elements and pressure elements (which often become soiled) is not enabled by this module.

Present franking systems lower the pressure elements by activating a lever, rotating wheel or a pawl. The pressure device thereby remains firmly connected with the franking machine or is only folded away. The lower transport unit of the franking machine is lowered or folded down in order to correct an existing paper jam. However, access to the sensors, transport elements and pressure elements continues to be difficult or impossible.

SUMMARY OF THE INVENTION

An object of the invention is to enable the maintenance of a printing apparatus without the aforementioned disadvantages of the prior art. An operator of the printing apparatus should be able to remove a box-shaped module from the printing apparatus and reinsert it in order to exchange a mat of an ink collector and in order to exchange the elements of the pressure unit. A correction of the jam should also be more easily possible for the operator, and access to the sensors should be enabled in order to be able to clean the sensor covers of the printing apparatus.

A more specific object of the invention is to achieve a device to lower, position and raise pressure elements of the pressure device. The removal of the box-shaped module should be possible in a smooth manner and, given a sliding of the box-shaped module into the printing apparatus, a positioning of the pressure elements relative to the transport belt of a transport unit should be enabled without a manual operation (except for the sliding) being required for this.

The above object is achieved in accordance with the invention by a printing apparatus of modular design that has a transport path for flat items to be transported in the x-direction of a coordinate system, wherein the printing apparatus allows an insertion of a box-shaped module in the y-direction and allows removal of the box-shaped module counter to the y-direction. The latter has a pressure device, two guide channels and a rocker with a respective connection element and a respective shaped part for each guide channel. The pressure device of the inserted module exerts a pressure in the z-direction on the flat items to be transported. The x-direction, y-direction and z-direction are orthogonal to one another. The box-shaped module in combination with guide means of the printing apparatus cooperate in order to initially move the pressure device opposite to the z-direction during the insertion of the box-shaped module into the printing apparatus and to move the pressure device in the z-direction upon reaching a predetermined position.

The printing apparatus has an upper housing shell below which a lower housing shell and the box-shaped module are arranged abutting one another. The upper housing shell comprises a transport unit with a transport belt driven by a drive unit; in the event of operation the lowerable pressure device of the box-shaped module is situated opposite said transport belt.

The pressure device has an elastically borne base with support receptacle for pressure elements in the z-direction and with connection elements integrally molded in the opposite direction. The pressure device is mechanically coupled with the rocker. Given the manual operation of the rocker, all pressure elements are lowered simultaneously counter to an elastic force of the pressure springs of the lowerable pressure device, and an obstruction is released which enables the removal of the box-shaped module. The obstruction is formed by at least one shaped part of the rocker and an associated recess in the guide means.

When the box-shaped module is inserted into the printing apparatus, the tip of the guide means and a contour of the shaped parts of the rocker meet one another. The guide means of the printing apparatus in cooperation with the associated shaped parts of the rocker initially produce an automatic lowering of the pressure device. Given a further insertion, each of the shaped parts meets a recess that has respectively been worked into the guide means at a first distance from its tip. The rocker in the box-shaped module and the shaped parts at the rocker are arranged so that the attitude of the recess produces the precise positioning of the pressure elements and a time-delayed raising of the pressure elements at the transport belt of the transport unit during the insertion of the box-shaped module. Due to the mechanical coupling of the rocker with the pressure device, a forced return is advantageously achieved to position the pressure elements on the conveyor belt during the insertion of the box-shaped module.

In the operating mode, a print head carriage with inkjet print heads can be moved into a printing position. In this position the box-shaped module cannot be removed. The access to some assemblies is thereby at least hindered. Only after switching the printing apparatus over into a service mode—wherein the print head carriage has been moved into a sealed position and a pusher has then additionally been manually operated—is the box-shaped module released for the purposes of a removal from the printing apparatus. In the service mode the transport unit or the motors of the printing apparatus are deactivated, and a cleaning and sealing station of the printing apparatus prevents the inkjet print heads from drying out in the sealed position. This is particularly advantageous if the box-shaped module is removed for a longer period of time.

The box-shaped module is designed so that it can be moved out of the way or displaced from the lower housing shell in the event of service. The box-shaped module is supported on two guide means that protrude forwards through a first and second opening on the front side of the lower housing shell. In the case of removal of the box-shaped module—i.e. in the event of service—both the pressure device and additional assemblies of the box-shaped module are accessible. After removal of the box-shaped module, the operator also has access to the sensors in the transport path for the purpose of cleaning them and to correct a jam of flat goods, for example mail pieces (letter jam).

The box-shaped module accommodates in a known manner the lower pressure device—for example a brush—whose pressure elements are the bristles of the brush. The box-shaped module can be pulled out of the printing apparatus (for example a franking machine) by the operator, which facilitates its maintenance. For example, the brush can be exchanged by the operator. The box-shaped module also comprises an ink sump reservoir with internally inlaid ink mat which can be exchanged by the operator.

DESCRIPTION OF THE PREFERRED EMBODIMENTS

Figure 1A:
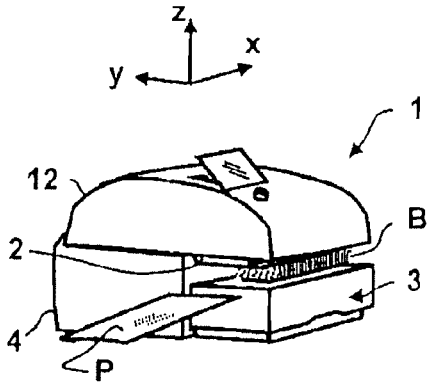
FIG. 1*a* is a perspective, principle depiction of a printing apparatus given an inserted, box-shaped module.

A printing apparatus 1 given an inserted, box-shaped module 3 in a perspective view from the upper front left is shown in FIG. 1*a*. The printing apparatus has an upper housing shell 12, below which a lower housing shell 4 is drawn abutting the box-shaped module 3 in the y-direction. The upper housing shell 12 is mounted on the lower housing shell 4 in the z-direction. The lower housing shell 4 forms a rear lower part of the printing apparatus and forms a seal with the upper housing shell at the rear and to the sides. The box-shaped module 3 that can be removed in the manner of a drawer (only in the service mode) is accommodated in the forward lower part of the printing apparatus and has a number of pressure elements B. In the front part, below the upper housing shell 12, a transport belt 2 of a transport unit is visible which serves to transport mail pieces in the x-direction (transport direction) in the printing mode, wherein the pressure elements B press a flat piece P to be printed onto the transport belt 2 from below (thus in the z-direction) as soon as the piece P is supplied to the printing apparatus 1. The printing mode is a special operation mode of the printing apparatus in which the at least one inkjet print head (not shown) is positioned in the forward part of the upper housing shell 12.

Figure 1B:
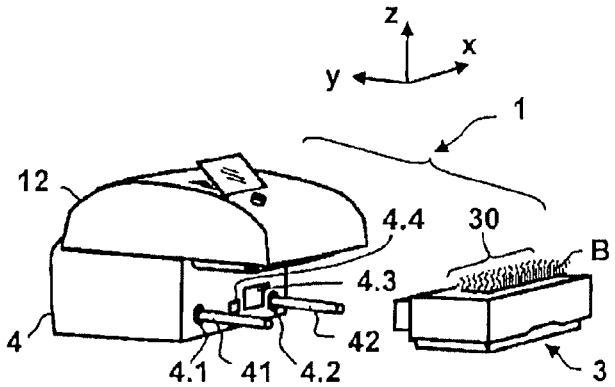
FIG. 1*b* is a perspective, principle depiction of a printing apparatus given a removed, box-shaped module.

FIG. 1*b* shows a printing apparatus 1 given a pulled-out, box-shaped module 3 in a perspective view from above and to the left. In the service mode the at least one inkjet print head (not shown) is positioned in the rear part of the upper housing shell 12, after it was moved there—transversely to the transport direction, thus in the y-direction—from the printing position in the printing mode. The box-shaped module 3 is shown removed from the lower housing shell 4, which is why two rails 41 and 42 are visible. The latter form guide means on which the box-shaped module is supported in the operating mode. They protrude forward through a first opening 4.1 and second opening 4.2 on the front side of the lower housing shell.

A third opening 4.3 and fourth opening 4.4 are situated between the first opening 4.1 and second opening 4.2. The first opening is arranged upstream (in terms of the mail flow) near the left side wall of the apparatus, the second opening is arranged downstream (in terms of the mail flow) near the right side wall of the apparatus, and the third opening is arranged to the left next to the second opening. The pressure elements B are a component of a lowerable pressure device 30 of the box-shaped module 3.

Figure 2A:
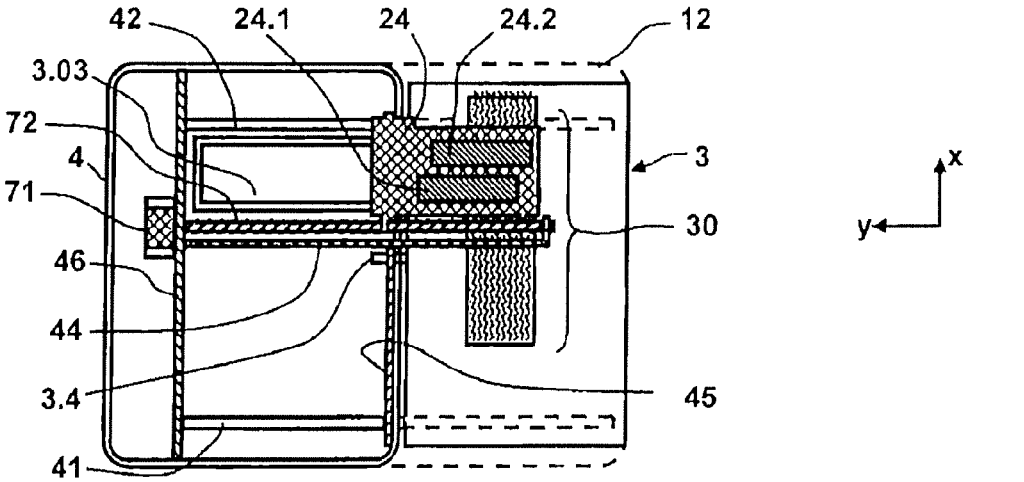
FIG. 2*a* is a plan view of the printing apparatus presented in section parallel to the x/y-plane given an inserted, box-shaped module and removed upper housing shell.

A plan view of the printing apparatus (shown in section parallel to the x/y-plane) given an inserted, box-shaped module 3 and in the operating case is shown in FIG. 2*a*. The removed upper housing shell 12 is drawn in dashed lines in order to clarify its position. The box-shaped module 3 has at its rear side a mechanical connection element 3.4 and an ink reservoir 3.03. The box-shaped module 3 is equipped with a feed table that has an opening at the top side for the pressure elements of the pressure device 30.

A pressure device is known from European Patent Application EP 2072268 A2, ("Device to Press Flat Items onto a Transport Module").

The print carriage 24 has a first and second cavity 24.1 and 24.2 for insertion of a respective ink cartridge. The upper housing shell 12 comprises a transport unit or drive unit with a transport belt that are attached to a chassis, as described in European Patent Application EP 2072272 A2 ("Transport Device for Flat Items to Be Printed").

A print carriage 24 (drawn in the printing position) can be moved via a spindle drive (comprising a part of the print carriage, not shown in detail, and a spindle 72 in the y-direction) by a motor 71 attached to a rear wall of a chassis or, respectively, rear frame wall 46. The rear frame wall 46 serves for attachment of the rails on which the print carriage 24 runs, which already arises from the European Patent Application EP 2072272 A2. For better clarity only the rails for guidance of the box-shaped module are shown, and the rails on which the print carriage 24 runs are omitted.

The rear frame wall 46 serves at least to support and possibly also for the attachment of both the first rail 41 and the second rail 42. A first frame wall 45 has a corresponding opening in order to support the first rail 41. A second frame wall 44 is arranged orthogonal to the rear frame wall 46 and runs near to the center of the lower housing shell 4 in order to connect the first frame wall with the rear frame wall.

Figure 2B:
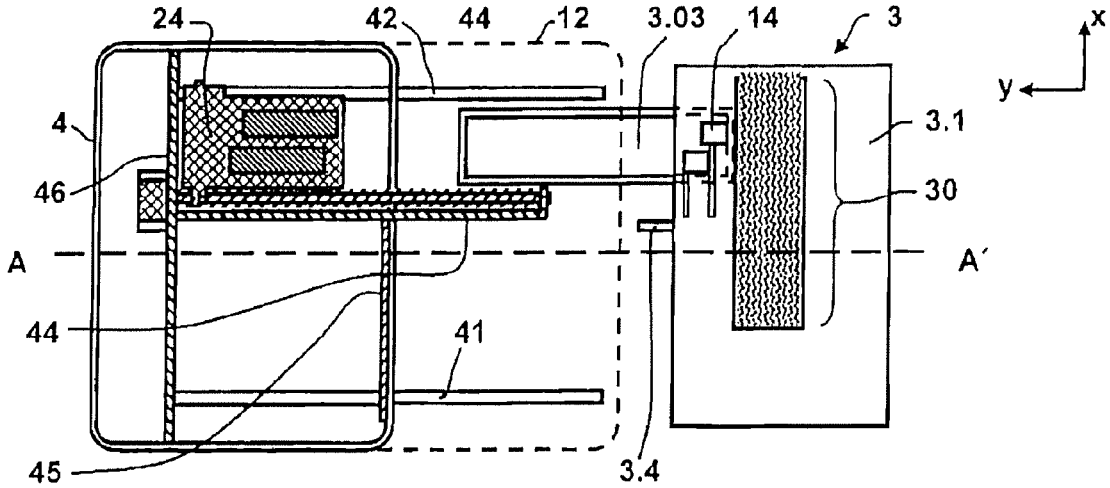
FIG. 2*b* is a plan view of the printing apparatus presented in section parallel to the x/y-plane given a removed, box-shaped module and removed upper housing shell.

A plan view of the printing apparatus 1 (shown in section, parallel to the x/y-plane) is shown in plan view in FIG. 2*b* given a removed, box-shaped module 3—i.e. in service mode—and given a removed upper housing shell. The position of the removed upper housing shell 12 is indicated again in dashed lines. The print carriage 24 (that is not drawn with dashed lines) is located in the sealed position. A hook as a mechanical connection element 3.4 and an ink reservoir 3.03 are integrally molded on the rear side of the box-shaped module 3. An opening for the pressure elements of the pressure device 30 is formed on the top side of the box-shaped module 3 in the feed table. The ink reservoir 3.03 is designed as a container with internally inlaid ink mat (said container projecting on the rear side of the box-shaped module 3) which, in the inserted state, projects into the third opening on the front side of the lower housing shell 4.

In the operating mode the ink reservoir 3.03 lies between the second rail 42 and the second frame wall 44 which are mounted on the rear frame wall 46, which is situated in the lower housing shell 3. In the printing region, located under each of the inkjet print heads is a spray shaft for spraying the nozzle clear on a shaft support 14 that can be deflected counter to an elastic force. Details for this can be learned from the European Patent Application EP 2072263 A2 with the title: "Vorrichtung zum Freispritzen eines Tintendruckkopfes" ["Device for clearance an inkjet print head"].

Figure 3A:
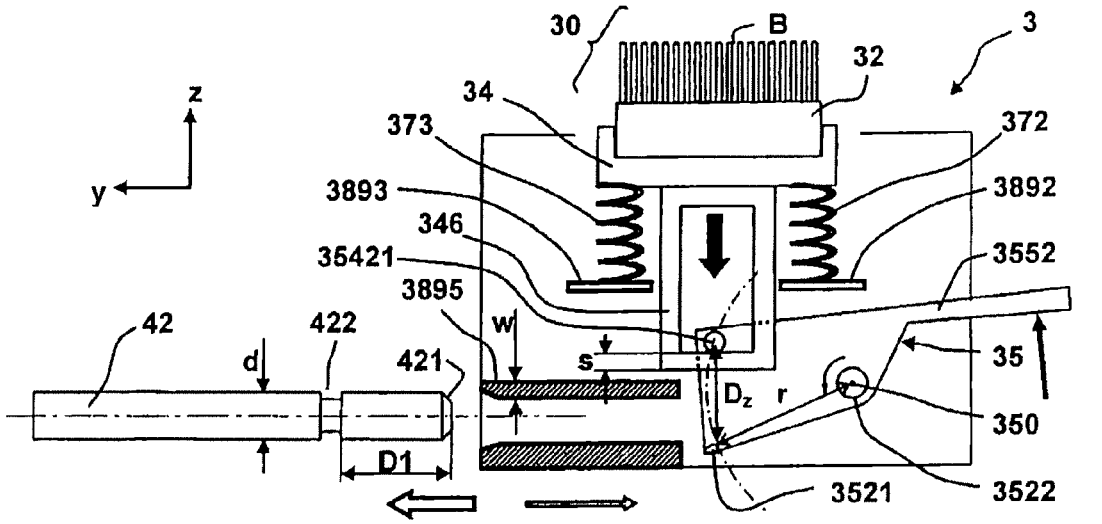
FIG. 3*a* is a schematic illustration of the device for positioning pressure elements of a printing apparatus in a view from the left (in the transport direction x) of the removed, box-shaped module shown in section parallel to the x/y-plane.

FIG. 3*a* shows a principle image of the device for positioning pressure elements of a printing apparatus with a view from the left (in the transport direction x) towards the removed, box-shaped module (shown in section parallel to the y/z-plane), which box-shaped module is drawn in section on the line AA' according to FIG. 2*b*. The housing of the box-shaped module 3 that was indicated with a line has an opening in the z-direction through which the support receptacle 32 protrudes with the pressure elements B of the pressure device 30. The support receptacle 32 is mounted on a base 34 that is elastically borne by compression springs 372, 373 and additional compression springs 371, 374 (not shown) in the housing of the box-shaped module 3. The compression springs 371, 372, 373 and 374 are arranged at the four corners of the base 34. The compression springs can be supported on support surfaces 3892, 3893 and additional support surfaces 3891, 3894 (not shown) which are integrally molded on the floor plate 38 or on the side walls of the housing of the box-shaped module 3.

Alternatively, the compression springs can flank the pressure device 30.

Arranged between the floor plate 38 and the base 34 is a rocker 35 which is borne on a shaft 3522 such that it can rotate around a rotation axis 350, wherein the rotation axis is aligned orthogonal to the y/z-plane and parallel to the transport direction x. The rocker 35 has a power arm 3552 and a load arm that extend from the rotation axis, starting in the y-direction to below the base 34. The load arm has a peg-like or pin-like connection element 35421 whose middle axis lies parallel to the rotation axis. The peg-like connection element 35421 is mechanically coupled with an eye hook-like connection element 346 molded on the base. The latter can be formed as a frame with a window-like opening. The peg-like connection element 35421 protrudes into this opening at the lower edge of the frame. The frame is molded on the base 34 at the opposite lower frame edge, i.e. in the z-direction. A force coupling thus arises via the connection elements 346 and 35421 between load arm of the rocker and the base charged with an elastic force by the compression springs. Given an actuation of the rocker 35—identified by a thin, black arrow—the frame, and simultaneously the pressure elements B, is lowered counter to the elastic force (thick black arrow). When the pressure elements are lowered, an obstruction is also released, which releases the box-shaped module for removal. The obstruction is explained further below using FIG. 3*c*. A removal of the box-shaped module 3 is thus enabled without a deformation of the pressure elements B. The removal direction is opposite the y-direction and is indicated by a long, thin, white arrow that is drawn below the box-shaped module 3. The box-shaped module 3 has a guide channel 3895 for a guide means. For example, a guide means forms a rail 42 with a round profile, advantageously with a circular cross section which has a diameter d.

A shaped part 3521 with a suitable contour lies on the load arm side of the rocker 35 at the same radial distance r from the rotation axis 350 as the middle axis of the bolt-like connection element 35421. For the case shown in the principle image according to FIG. 3*a*—that the shaped part 3521 and the peg-like connection element 35421 obtrude at one and the same side wall surface of the load arm side of rocker 35—a distance Dz is necessary between the shaped part 3521 and the bolt-like connection element 35421 in the z-direction. The distance between the connection element 35421 and the contour 3521 results due to stacked arrangement from the sum of a diameter d of the rail 42, the wall thickness w of the guide channel 3895 and the frame width s, as well as a safety interval q.

However, for the case that the shaped part 3521 and the bolt-like connection element 35421 do not obtrude on one and the same side wall surface of the load arm side of the rocker 35, a smaller distance is also possible between the shaped part 3521 and the bolt-like connection element 35421. An exemplary embodiment is shown using FIGS. 4*a* and 4*b* with different distances in the z-direction and in the y-direction.

Upon insertion of the box-shaped module 3 into the printing apparatus, the module 3 is manually moved in the y-direction, which is indicated with a thick white arrow. The rail 42 is inserted into a guide channel 3895 of the box-shaped module 3. The guide channel 3895 is expanded like a cone for an easier insertion in the y-direction. A second guide channel 3894 is identical in design but not visible since it was cut off in FIG. 3*a*.

To facilitate the insertion, the guide means have a stage or, respectively, tip at the respective protruding ends. A rail 42 with a circular cross section of diameter d has a smaller diameter at the end, thus a conically tapered tip or a rounded tip 421. An annular groove 422 is worked into the rail 42 at a distance D1 from the tip. The second rail 41 (not shown) is designed just like the rail 42. The truncated part of the box-shaped module 3 that is not shown can be designed symmetrical to the shown part of the box-shaped module 3.

The components of box-shaped module 3 are the elastically supported base with pressure element support receptacle and with integrally molded connection elements, two guide channels and the rocker with a respective connection element and a respective shaped part for each guide channel. These components are arranged so that they, in combination with guide means of the printing apparatus, automatically produce a lowering of the pressure elements before positioning of the pressure elements and a raising of the pressure elements after positioning of the pressure elements.

Differently from the removal of the box-shaped module 3, in the insertion of said box-shaped module 3 the rocker 35 is automatically activated, which is described in detail in the following using FIG. 3*b*. The mechanism to automatically lower the pressure device 30 is based on the principle of displacement of oblique planes counter to one another, thus the contour of the shaped part 3521 and/or the tip of the rail 42 during the insertion. Due to the automatic lowering of pressure elements of the printing apparatus, no deformation of the pressure elements B or change of the desired attitude into an attitude rotated transversal to the transport direction can arise due to the insertion.

During the insertion of the box-shaped module, the contour of the shaped part 3521 of the rocker 35, together with the clearance D1 of the annular groove 422, moreover produces a delay of the lifting of the pressure elements B at the transport belt of the transport unit, which is likewise explained in the following using FIG. 3*c*.

Figure 3B:
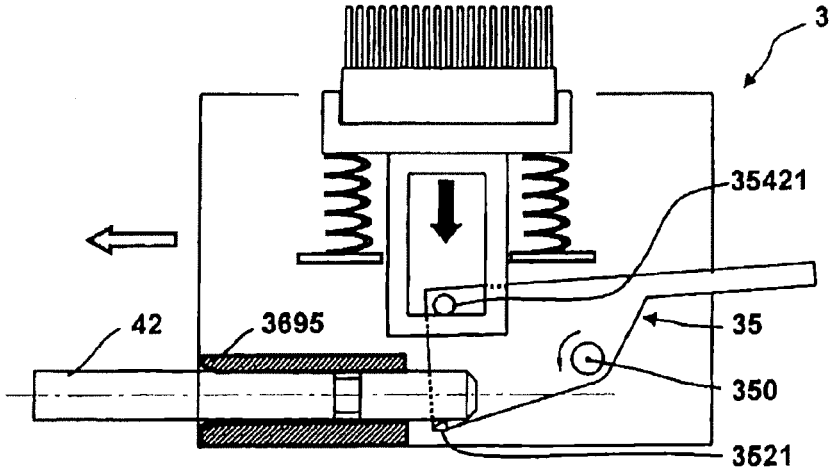
FIG. 3*b* is a side view from the left of the box-shaped module, shown in section parallel to the x/y-plane, during the insertion into the printing apparatus.

FIG. 3*b* shows a side view from the left of the box-shaped module 3 shown sectioned parallel to the y/z-plane during the insertion into the printing apparatus. The conically tapered tip or a rounded tip 421, in cooperation with the contour of the shaped part 3521 at the rocker 35, has the effect that upon insertion the rocker 35 does not need to manually operated. Via the oblique planes of the contour of the shaped part 3521 and/or of the tip of the rail 42, the bolt-like connection element 35421 of the rocker 35 is also deflected counter to the elastic force of the compression springs (thick black arrow) and the rocker is rotated around the rotation axis 350 (small black rotation arrow). During the insertion into the printing apparatus the box-shaped module 3 is manually moved in the y-direction, which is clarified by a thick, white arrow.

Figure 3C:
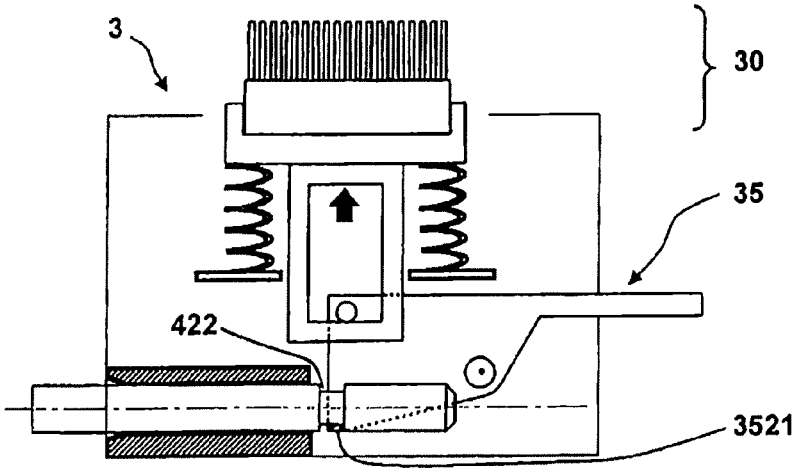
FIG. 3*c* is a side view from the left of the box-shaped module, shown in section parallel to the x/y-plane, that is inserted and automatically positioned in the printing apparatus.

FIG. 3*c* shows a side view from the left of the box-shaped module 3 shown sectioned parallel to the y/z-plane, which box-shaped module 3 is inserted into the printing apparatus and is automatically positioned as soon as the shaped part 3521 of the rocker 35 engages in the annular groove 422. The bolt-like connection element 35421 is thereupon moved a distance in the z-direction corresponding to the effect of the elastic force, which is indicated by a thick, black arrow. As a result of the insertion of the box-shaped module, an automatic return for positioning the pressure device 30 and a raising onto a transport belt (not shown) for the purpose of pressing the pressure elements B (brush) are achieved.

To remove the box-shaped module, the rocker 35 must be operated manually via the power arm so that the pressure elements B are lowered. A barrier which is realized by the shaped part 3521 of the rocker 35 which engages in the annular groove 422 is thereby also released.

Figure 4A:
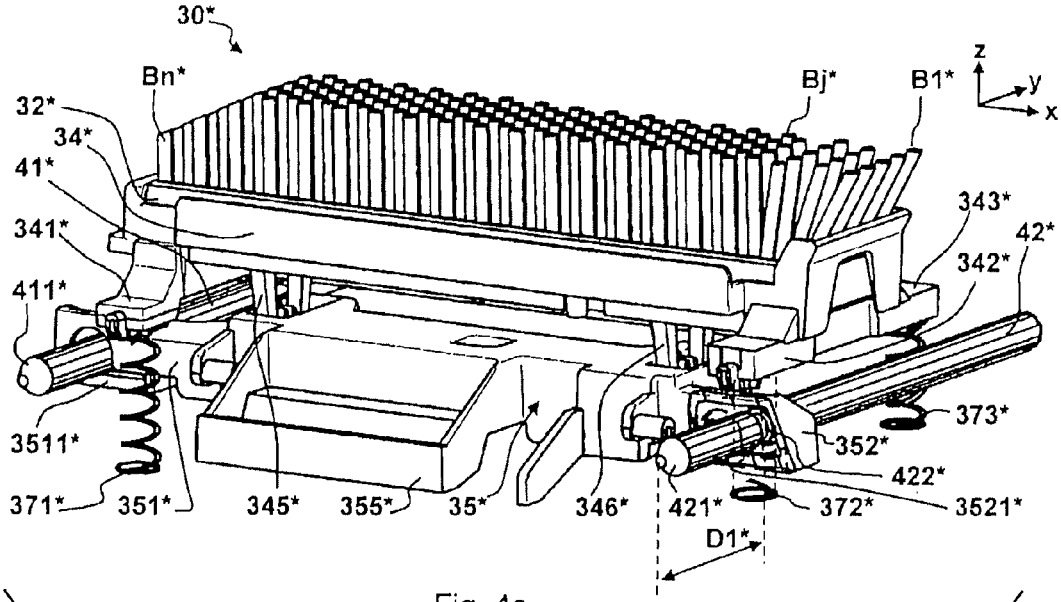
FIG. 4*a* is a perspective view of a mechanism to automatically lower the pressure device and raise it with a time delay.

FIG. 4*a* shows a perspective representation of a mechanism for automatically lowering and—with a time delay—raising the pressure device 30* upon insertion of the box-shaped module. A plurality of elastic pressure elements B1*, . . . , Bj*, . . . , Bn* are attached to a support receptacle 32*. The elastic pressure elements B1*, . . . , Bj*, . . . , Bn* comprise plastic and/or metallic bristles. The support receptacle 32* is mounted on a base 34* such that said support receptacle 32* can be exchanged. The bristles and the support receptacle are connected with one another via a material bone and shaped like a brush. The support receptacle 32* has a rectangular floor surface at the floor of a cavity worked into the base 34*, into which cavity the support receptacle fits. The connection of the support receptacle 32* with the base can be realized positively and/or non-positively.

The elastic effect of the pressure elements is sufficient in order to be able to process mail pieces P of different thicknesses. The brush is additionally sloped toward the input end of the mail flow, meaning that the length of the bristles increases in the x-direction in order to be able to better absorb shocks due to successive mail pieces of different thickness. The elastic effect of the pressure elements is not yet sufficient in order to be able to also process larger thickness of the mail pieces P. Therefore, a respective one of the guide elements 341*, 342*, 343* or 344*(occluded) and a respective one of the associated compression springs 371*, 372*, 373* or 374* (occluded) are provided at each of the four corners of the base 34*. For the sake of better clarity, a floor plate has not also been shown on which the base 34* is elastically supported from below—i.e. counter to the z-direction—by means of the aforementioned compression springs. The base 34* has two integrally molded, eye hook-like connection elements 345* and 346* spaced apart from one another in the transport direction (x-direction), which connection elements 345* and 346* extend downward, i.e. counter to the z-direction. They are respectively connected with a bolt-like connection element of a rocker 35*. The rocker has at its forward-facing end a handle 355*. The eye hook-like connection elements 345* and 346* are integrally molded on a rear-facing (i.e. pointing in the y-direction) lever arm end. The rotation axis of the rocker is situated parallel to the x-direction. Box-shaped operating elements 351* and 352* are arranged on a line parallel to the x-direction, between the rotation axis and the bolt-like connection elements of the rocker 35* on the respective right and left side of the rocker 35*. The box-shaped operating elements 351* and 352* respectively have an opening and an operating edge 3511* and 3521*. The first rail 41* and the second rail 42* are attached (the manner is not shown) with their one end to the rear wall of the chassis and respectively have a conically tapering tip 411* and 421* at their other, forward-directed end. For the sake of better clarity, a box-shaped operating element 352* and the compression springs 372* have been shown truncated. The rails 41* and 42* respectively have an annular groove that is respectively arranged at a distance in the y-direction from the tips 411* and 421*. The annular groove 422* has a first distance D1 from the tip 421*. The rocker 35* is actuated by the tips and the annular groove of the rails 41* and 42* that rest on the operating edge 3511* and 3521* upon insertion of the box-shaped module.

Figure 4B:
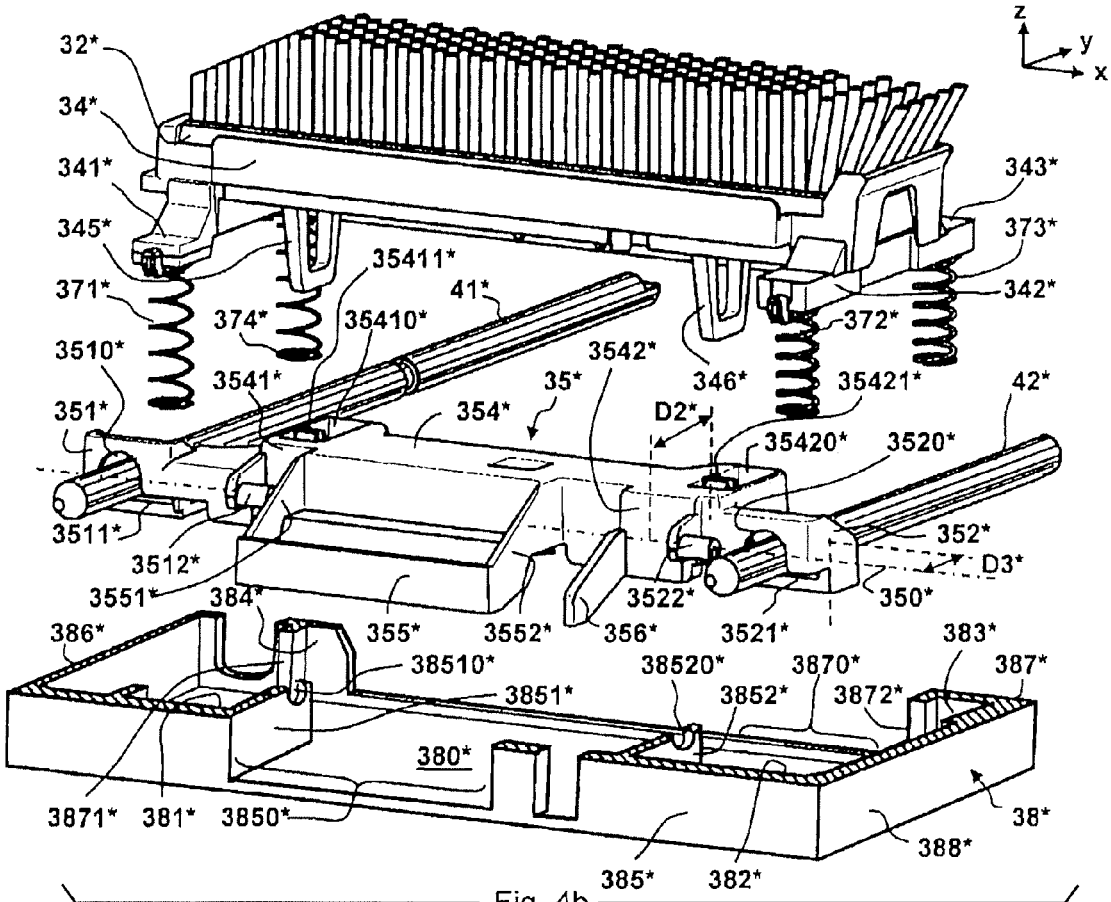
FIG. 4*b* is an exploded view of the mechanism according to FIG. 4*a*.

FIG. 4*b* shows an exploded presentation of the mechanism. The elastic pressure elements B1*, . . . , Bj*, . . . , Bn* and the support receptacle 32* as well as the base 34* with the eye hook-like connection elements 345* and 346* and the guide elements 341, 342, 343 (344 is occluded) and a respective associated compression spring 371, 372, 373 or 374 are shown installed. The rocker and the first rail 41* and the second rail 42* are shown together for the sake of better clarity.

The operating edges 3511* and 3521* of the box-shaped operating elements 351* and 352* at the respective right and left side of a rocker lever arm 354* lie removed at a shorter distance D3 from the rotation axis 350* in the y-direction than the bolt-like connection elements 35411* and 35421* of the rocker that are arranged at a second distance D2 from the rotation axis 350* in the y-direction. A load arm extending in the y-direction has a length corresponding to the second distance D2, and a power arm of the rocker 35* extending in the y-direction has a length corresponding to the third distance D3. Power arm and load arm are thus situated on the same side of the rocker 35* and form an angle lever. The base 34* is pressed upwardly by the compression springs with a force pointing in the z-direction. In the installed state, the force of the four compression springs is transferred to the load arm by the eye hook-like connection elements 345* and 346* and via the bolt-like connection elements 35411* and 35421* of the rocker 35*, and the pusher 355* on the other side of the rocker 35* is inclined towards the top 380* of the floor plate 38*. A vane 356* which protrudes counter to the y-direction is integrally molded at a distance from the right lateral part 3552* of the pusher 355*. The movement of the pusher 355* of the rocker 35* is downwardly bounded by the vane 356* if the latter strikes the top side 380* of the floor plate 38*. While the pusher 355* and the vane 356* are arranged on the one side of the rocker 35* that points forward, the opposite side of the rocker 35* points backward, i.e. in the y-direction. A shaped part 354* extends in the x-direction on the latter cited side of the rocker 35*. To the left of a left pusher side part 3551* and to the right of the vane 356*, the shaped part 345* passes into a left and right, approximately cuboid housing. Each of the left and right, approximately cuboid housings 3541* and 3542* has an upwardly open cavity 35410* and 35420* into which the respective bolt-like connection elements 35411* and 35421* extend in the x-direction.

A vane directed forward—i.e. extending counter to the y-direction—that supports a cylindrical shaft part, is integrally molded at each of the outer left end and right end of the left and right, approximately cuboid housings 3541* and 3542*, and the rotation axis 350* of the rocker 35* travels centrally through the shaft parts 3512* and 3522*.

The box-shaped operating elements 351* and 352* are integrally molded at the outer left and right end of the left and right, approximately cuboid housing 3541* and 3542*.

Each of the two box-shaped operating elements 351* and 352* has an opening 3510* or 3520* for insertion of the rails 41* or 42*, and an operating edge 3511* or 3521*.

In the exploded presentation a floor plate 38* has been shown separately that—for the sake of better clarity—is drawn sectioned parallel to the x/y-plane. A box-shaped design with the outer walls 385* to 388* increases the dimensional stability of the floor plate 38*. A forward outer wall 385* has at least one opening 3850* for the pusher 355*. Integrally molded on the front outer wall 385* are left and right inner side walls 3851* and 3852* which respectively have a bore 38510* or 38520* therein. These bores are designed to accommodate the shaft parts 3512* and 3522*, respectively, as a result of the installation. As a result of the installation, the guide elements 341*, 342*, 343* or 344* (occluded) also engage with the inner walls 381*, 382*, 383* or 384* of the floor plate 38*. Moreover, guide webs 3871* and 3072* are molded into the floor plate 38* to guide the guide elements. The floor plate is installed in the housing of the box-shaped module 3.

Alternatively, it is provided to shape the housing with integrated floor plate in the injection molding method.

Although modifications and changes may be suggested by those skilled in the art, it is the intention of the inventors to embody within the patent warranted hereon all changes and modifications as reasonably and properly come within the scope of their contribution to the art.

We claim as our invention:

1. A printing apparatus comprising:

an apparatus housing configured to form a transport path for items to be printed proceeding in an x-direction of a Cartesian coordinate system in the apparatus housing, said apparatus housing comprising guide elements proceeding in a y-direction of the Cartesian coordinate system;

a box-shaped module configured to engage and move on said guide elements toward and away from said apparatus housing along said y-direction, so as to be completely removed from said apparatus housing;

said box-shaped module comprising a pressure device configured to urge said items in said transport path along a z-direction of said Cartesian coordinate system away from said box-shaped module, a portion of said pressure device projecting from said box-shaped module and thereby presenting an obstruction to said apparatus housing upon removal and insertion of said box-shaped module from and to said apparatus housing;

said box-shaped module comprising two guide channels therein that respectively receive and engage said guide elements when said box-shaped module is reinserted toward said apparatus housing along said y-direction after being removed from said apparatus housing;

in each of said guide channels, said box-shaped module comprising a rocker having a shape configured to interact with the respective guide element in the respective guide channel as said box-shaped element is moved toward said apparatus housing, to initially move said pressure device away from said apparatus housing during insertion of the box-shaped module by an amount that clears said portion from said apparatus housing so that said portion does not present said obstruction, and to subsequently move the pressure device away from said box-shaped module toward said transport path upon said box-shaped module reaching a predetermined position relative to said apparatus housing.

2. A printing apparatus as claimed in claim 1 wherein said transport path of said printing apparatus comprises a transport belt that engages said items to be printed to move said items along said transport path in said x-direction, and wherein said pressure device is situated beneath and opposite said transport belt when said box-shaped module is in said predetermined position, and wherein said pressure device comprises a resiliently supported base having a support receptacle that contains a plurality of pressure elements proceeding in said z-direction, and connection elements integrally molded in an opposite direction, said support receptacle being mechanically coupled with the respective rockers in the respective channels.

3. A printing apparatus as claimed in claim 2 wherein said pressure device is resiliently supported by compression springs and wherein, when said box-shaped module is in said predetermined position, a shaped portion of each rocker interacts with a recess in each guide element to form a barrier against removal of said box-shaped module from said apparatus housing, and wherein said rocker is externally manually accessible from said box-shaped module and wherein, upon manual operation of said rocker, said barrier is released to enable removal of said box-shaped module from said apparatus housing.

4. A printing apparatus as claimed in claim 2 wherein each of said guide elements comprises a guide element tip, and wherein each guide element tip interacts with the respective rocker in the respective guide channel to initially automatically lower said pressure device when the tip of each guide elements engages a peripheral contour of the respective rocker.

5. A printing apparatus as claimed in claim 2 wherein each guide element has a recess therein, said recess being located at a distance from a tip of each guide element, and wherein said rocker is configured so that an orientation of the recess causes selected positioning of said pressure elements with a time-delayed raising of said pressure elements toward said transport belt during insertion of said box-shaped module into said apparatus housing.

6. A printing apparatus as claimed in claim 5 wherein each of said guide elements is a rail having a rounded profile, and wherein said recess is an annular groove.

7. A printing apparatus as claimed in claim 1 wherein said transport path of said printing apparatus comprises a transport belt that engages said items to be printed to move said items along said transport path in said x-direction, and wherein said pressure device is situated beneath and opposite said transport belt when said box-shaped module is in said predetermined position, and wherein said pressure device comprises a resiliently supported base having a support receptacle that contains a plurality of pressure elements proceeding in said z-direction, and connection elements integrally molded in an opposite direction, said support receptacle being mechanically coupled with the respective rockers in the respective channels and wherein said support receptacle is mechanically coupled with said rocker by respective connection elements at a base of the support receptacle formed as eye hooks and connection elements at said rocker formed as pegs.

* * * * *